US005769681A

United States Patent [19]

Greenwood, Sr. et al.

[11] Patent Number: 5,769,681

[45] Date of Patent: Jun. 23, 1998

[54] OPEN-ENDED TOY CONSTRUCTION SYSTEM

[76] Inventors: Donald Lee Greenwood, Sr., 3117 Lakeshore Dr., Longmont, Colo. 80503; Donald Lee Greenwood, Jr., 2200 Tulip St., Longmont, Colo. 80501; Heidi Greenwood Pate, 1196 Garfield Ave., Louisville, Colo. 80027

[21] Appl. No.: 591,709

[22] Filed: Jan. 25, 1996

[51] Int. Cl.[6] ..... A63H 33/08

[52] U.S. Cl. ..... 446/120

[58] Field of Search ..... 446/120, 121, 446/126, 103, 104, 116

[56] References Cited

U.S. PATENT DOCUMENTS

| | | | |
|---|---|---|---|
| 2,662,335 | 12/1953 | Calverley | 446/120 X |
| 2,752,726 | 7/1956 | Calverley | 446/120 X |
| 2,909,867 | 10/1959 | Hobson | 446/126 X |
| 2,972,833 | 2/1961 | La Grutta | 446/121 |
| 3,475,023 | 10/1969 | Fauvelle | 446/116 X |
| 3,597,874 | 8/1971 | Ogsbury | 446/104 |
| 3,654,726 | 4/1972 | Witte | 446/103 |
| 3,747,261 | 7/1973 | Salem | 446/104 |
| 4,012,155 | 3/1977 | Morris | 446/116 X |
| 4,169,332 | 10/1979 | Fischer | 446/103 |
| 4,253,268 | 3/1981 | Mayr | 446/104 |
| 4,617,001 | 10/1986 | Parein | 446/120 X |
| 4,738,648 | 4/1988 | Berndt | 446/120 |
| 4,947,527 | 8/1990 | Hennig | 446/120 X |
| 5,194,031 | 3/1993 | Sahler | 446/103 |
| 5,368,514 | 11/1994 | Glickman et al. | 446/120 X |

*Primary Examiner*—William H. Grieb
*Attorney, Agent, or Firm*—Grimes & Battersby, LLP

[57] ABSTRACT

A toy construction system is provided for permitting the construction of a variety of different structures in varying sizes and shapes. The toy construction system includes a plurality of elongated rod members and a plurality of substantially flat connector members which may be interconnected in different combinations. Ball elements are provided on certain of the members which are adapted to engage complimentary socket elements contained on other members in order to rotatably interconnect the two members. The socket elements include means for positively retaining the ball elements within the socket elements and means for facilitating the insertion and removal of the ball elements into and out of said socket elements. The members may further include coupling element for rotatably engaging other members including spherical means. The members may still further include means for engaging other members by the use of a releasable hinge. A power transmission unit may be further included.

44 Claims, 6 Drawing Sheets

OPEN-ENDED TOY CONSTRUCTION SYSTEM

BACKGROUND OF THE INVENTION

1. Field of the Invention

The present invention relates generally to an open-ended toy construction system and, more particularly, to such a system which includes a plurality of rod members and connector members that may be rotatably connected in a variety of different combinations to permit the construction of a virtually unlimited number of different shapes and forms. The rod members are tubular in shape and, in a preferred embodiment, include socket elements at their opposite ends. The rod members may also include, at predetermined positions thereon, at least one spherical element.

The connector members are preferably flat, geometrically shaped pieces that may assume virtually any size or shape. The connector members include at least one and, preferably, a plurality of ball elements at predetermined positions about the periphery thereof. These ball elements are complimentary in size and shape to the socket elements on the rod members. In addition, the connector members may also include one or more coupling elements, complimentary in size and shape to the socket elements, to receive and rotatably engage ball elements and/or spherical elements.

The rod members and connector members are adapted to be connected in a variety of different combinations by engagement of the ball elements on the connector members with the socket elements on the rod members. The rod members and the connector members may also be connected by engagement of the spherical element on the rod member with the coupling element on the connector member or by any combination thereof.

Various combinations and alternative embodiments of the toy construction system of the present invention are possible. For example, the locations of the ball elements and socket elements may be reversed by providing the socket elements on the connector members and the ball elements on the rod members. Other alternative versions include, for example, the replacement of the ball and socket joint with a "hinge" type connector between complimentary elements.

2. Description of the Prior Art

The use of construction toys having ball and socket joints for connecting various components of the toys has been described in prior patents although, heretofore, such toy products have not been commercially successful. For example, U.S. Pat. No. 2,752,726, which issued to G. H. Calverley on Jul. 3, 1956 for Sectional Toy Figures, is directed to a doll figure with tubular limb elements that contain ball and socket joints to interconnect with one another as well as to connect to the trunk. U.S. Pat. No. 3,747,261 which issued to N. Salem on Jul. 24, 1973 for Ball and Rod Linkage for Joining Polyhedral Members is directed to a ball and socket linkage for interconnecting polyhedral elements to form executive toys. Individual balls having apertures passing therethrough are provided which are adapted to receive rods through said apertures. The polyhedral members include sockets which are adapted to receive and engage the separate balls to actually form the toy.

Other examples of interlocking construction toys include U.S. Pat. No. 2,909,867 which issued to W. J. Hobson on Oct. 27, 1959 for Constructional Toy which includes a plurality of different shaped gussets and beams that may be interconnected using interfitting flat male and female connectors; U.S. Pat. No. 3,654,726 which issued to D. C. Witte on Apr. 11, 1972 for Toy Building Set and Disc-Like Units Therefor which is directed to a toy building set which serves as a female connector for other toy members; U.S. Pat. No. 4,617,001 which issued to E. W. Parein on Oct. 14, 1986 for Elements of a Construction or Assembly Set and Accessories which teaches the use of a series of detachable links for joining components in a construction set; U.S. Pat. No. 4,947,527 which issued to M. R. Henning on Aug. 14, 1990 for Coupling System for Modular Article which is directed to a ball and socket coupling system for components of a toy vehicle; and U.S. Pat. No. 5,368,514 which issued to J. I. Glickman on Nov. 29, 1994 for a Vehicle Track Support For Construction Toy System which teaches an interlocking track system where the component portions are connected using connectors having ball and socket joints.

Examples of the use of ball and socket joints in non-construction toy applications include U.S. Pat. No. 3,475,023 which issued to R. M. Fauvelle on Oct. 28, 1969 for Skip Rope Formed of Sections which employs a ball socket and U.S. Pat. No. 4,012,155 which issued to M. O. Morris on Mar. 15, 1977 for Snap Lock Connector for Components such as Knock-Down Furniture Components which teaches the use of snap lock connectors for connecting furniture components.

The aforementioned prior art fails, however, to address or consider the objective sought by applicants, namely a toy construction system that includes a plurality of differently shaped members that may be rotatably interconnected in a variety of different combinations to create virtually an unlimited number of shapes and forms.

SUMMARY OF THE INVENTION

Against the foregoing background, it is a primary object of the present invention to provide an open-ended, toy construction system composed of a plurality of members adapted to be interconnected to one another to form toys of different sizes and shapes.

It is another object of the present invention to provide such a system in which the members may rotatably interconnected using complimentary ball and socket joints.

It is yet another object of the present invention to provide such a system in which the ball and socket joints are able to securely interconnect the members yet permit a wide range of rotational movement of the members relative to each other.

It is yet still another object of the present invention to provide such a system in which the ball and socket joints are adapted to permit joined members to releasably lock in certain angular positions relative to each other.

It is yet still another object of the present invention to provide such a system in which, in an alternative embodiment, the members are interconnected by hinge type connectors.

To the accomplishments of the foregoing objects and advantages, the present invention, in brief summary, comprises a toy construction system for permitting the construction of a variety of different structures in varying sizes and shapes. The toy construction system includes a plurality of elongated rod members and a plurality of substantially flat connector members which may be rotatably interconnected in a variety of different combinations. Ball elements are provided on certain of the members which are adapted to engage complimentary socket elements provided on other of said members in order to rotatably interconnect the two members. The socket elements include means for positively retaining the ball elements therein and means for facilitating the insertion and removal of the ball elements into and out of said socket elements. The rod members may further include spherical elements positioned on the body portion thereof. The connector members may include at least one coupling element positioned in the center of said member for rotatably engaging the spherical elements on the rod members or, alternatively, ball elements. The system may further include flat hinged connector members including hinge elements for interconnecting said hinged connector members and a power transmission unit which includes a base and a plurality of the rod members and connector members.

BRIEF DESCRIPTION OF THE DRAWINGS

The foregoing and still other objects and advantages of the present invention will be more apparent from the detailed explanation of the preferred embodiments of the invention in connection with the accompanying drawings, wherein.

BRIEF DESCRIPTION OF THE PREFERRED EMBODIMENTS

Figure 1:
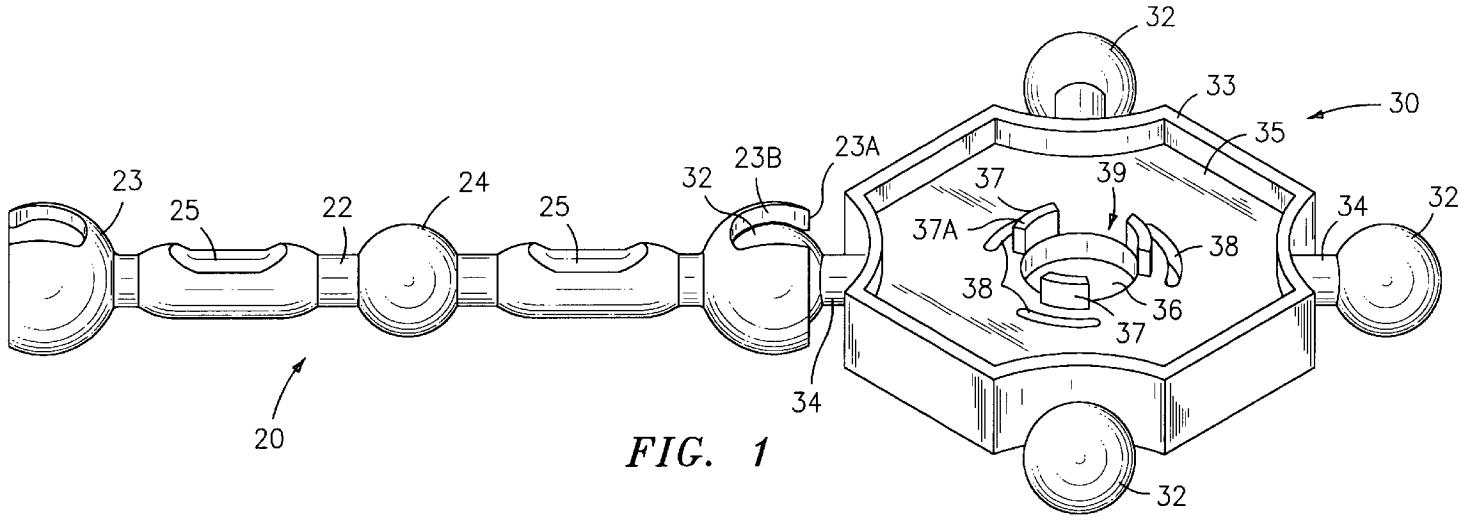
FIG. 1 is a front perspective view of the toy construction system of the present invention.

As shown in greater detail in FIG. 1, the open-ended toy construction system of the present invention, referred to generally by reference numeral 10, includes at least one rod member 20 and at least one connector member 30. It will, of course, be appreciated, that the toy construction system 10 actually includes a plurality of rod members 20 as well as a plurality of connector members 30. It will be further appreciated that while only one type of rod member 20 and one type of connector member 30 are shown in FIG. 1, rod members 20 and connector members 30 may assume a myriad of different sizes, shapes and configurations as will be described and illustrated in greater detail.

While rod members 20 and connector members 30 may take a variety of different sizes, shapes or configurations, they are all adapted to be rotatably joined with other members. In this regard, each member includes at least one element of a unique ball and socket joint which permits the member to be connected to another member. The unique ball and socket joint formed by the union of elements contained on two different members will be described in greater detail.

As shown in FIGS. 1 through 5, rod member 20 may be jointed to a connector member 30 by the engagement of complimentary ball and socket elements provided on these members. In the preferred embodiment illustrated in these figures, socket elements 23 are provided at the outward ends of rod member 20 and are adapted to engage complimentary ball elements 32 provided at pre-determined positions around the perimeter of connector member 30. Stems 34 cause the ball elements 32 to extend outwardly from the connector member 30. The specific location of the socket elements 23 on rod member 20 and the ball elements 32 on connector member 30 are matters of design choice and may vary from member to member.

Rod member 20 has a tubularly shaped body portion 22 with a socket element 23 provided on at least one and, preferably, both ends thereof. The socket element 23 is constructed from a flexible, thermoplastic material such as, for example, polyethylene or polystyrene. The unique construction of the socket element 23 allows the ball element 32 to be easily inserted into the socket element 23 and quickly removed therefrom to facilitate assembly and disassembly of toy products. The shape and configuration of the ball elements 32 and socket elements 23 are closely controlled to insure that the ball element 32 is securely retained within the socket element 23 yet permits full rotation of the rod member 20 during engagement. Retention of the ball element 32 within the socket element 23 is accomplished by an inwardly extending lip 23A provided around the outer edge of the socket element 23. The inner diameter of lip 23A is slightly less than the inner diameter of both the ball element 32 and the inner portion of the socket element 23. Thus, the lip 23A serves to secure the ball element 32 within the socket element 23 and prevent dislodgement of same during use.

Socket element 23 further includes two opposed, cut-out portions 23B which are designed to facilitate insertion into and removal of the ball element 32 from the socket element 23 as well as increase the degree of possible rotation for the ball element 32 within the socket element 23. It will be appreciated that due to the resilient, flexible nature of the socket element 23, the cut-out portions act as a spring to permit insertion into and removal of the ball element 32 from the socket element 23 as they permit the lip 23A to deflect outwardly upon insertion and removal of the ball element 32 from the socket element 23. This is a distinct advantage of the design over prior art socket elements since the spring bias created by the resiliency of the socket element 23 serves to positively retain the companion ball elements 32 in position during engagement yet facilitate removal therefrom. Cut-out portions 23B further serve as paths for the stems 34 of the ball elements thereby increasing the range of rotation possible for the ball element 32.

A spherical element 24 may also be provided at any position along the body portion 22, although preferably in the center thereof. Spherical element 24 is of a similar size and shape as the ball elements 32 provided on the connector member 30 and is adapted to be received within a socket element 23. Thus, spherical element 24 permits engagement of the rod member 20 with another rod member 20 or any other member having a socket element 23 thereon in the same manner as the union between the ball elements 32 and the socket elements 23.

As shown in FIGS. 1 through 5, the rod member 20 may further include at least one and preferably two grooved portions 25 on the tubular body portion 22 of the rod member 20. Grooved portions 25 may be simply an indentation in the body portion 22 or, alternatively (not shown) pass through such body portion 22 to permit attachment of various items or other elements to the rod member 20.

As previously indicated, connector member 30 includes at least one and preferably a plurality of ball elements 32 positioned around the periphery of the connector member 30. Ball elements 32 extend outwardly from the body 33 of the connector member 30 by stems 34. The size and shape of the ball elements 32 are complimentary to the size and configuration of the socket elements 23 into which they are adapted to be inserted to form the unique ball and socket joint of the present invention.

An aperture 36 may be provided through the flat, center portion 35 of the connector member 30, preferably at the center thereof. At least two and preferably three retaining shoulders 37 are provided around the periphery of the aperture 36 to form a coupling element 39 of similar size and shape to the socket element 23 provided at the ends of the rod member 20. A plurality of shoulders 37 are provided about the aperture 36 to create a socket-like structure to permit engagement with a spherical element 24 or a ball element 32. Slots 38 are provided through the center portion 35 of the connector member 30 between the shoulder 37 and the wall 33.

Figure 6A:
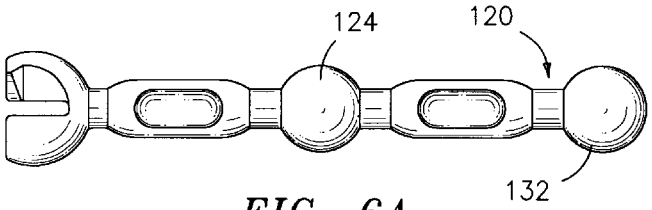
FIG. 6A is a side view of an alternatively configured rod member that may be used in the toy construction system of the present invention.

Coupling element 39 is adapted to receive and retain a ball element 32 or a spherical element 24 from another member between the shoulders 37 to permit interconnection between such members. Shoulders 37 include an inwardly projecting lip 37A to positively retain the ball element 32 or spherical element 24 within this coupling element 39. In this instance, the rod member 120 illustrated in FIG. 6A is particularly suitable for such arrangement since its includes a ball element 132 at an end thereof which may be easily inserted through a coupling element 39.

Coupling element 39 is adapted to engage a ball element 32 from another member or, alternatively, the spherical element 24 from a rod member 20. For example, it is possible to pass a rod element 20 such as the one shown, for example, in FIGS. 1, 6A or 6B, through the center aperture 36 and engage the rod member 20 to the connector member 30 by engagement of the spherical element 24 at the center of the rod member 20 with the coupling element 39 in the center of the connector members 30. In this manner, multiple members can be joined to a single connector member 30 in a variety of different ways. For example, multiple rod members 20 may be connected to the connector member 30 by engagement of the socket elements 23 provided at the ends of the rod members 20. In addition, another rod member 20 may be connected to the coupling element 39 on the connector member 30 by engagement of the spherical element 24 on the rod member 20 with the coupling element 39 on the connector member. Alternatively, another connector member may be connected to that same connector member 30 by engagement of a ball element on the other connector member with the coupling element 39 on the connector member 30.

It will, of course, be appreciated that the coupling element 39 incorporates many of the same features as the socket elements 23. The shoulders 37 serve to define a socket wall while lip 37A is similar to lip 23A provided at the outward end of the socket element 23. Moreover, the spaces 38 serve much the same function as cut-out portions 23B provided in the socket elements 23 in that they serve to facilitate deflection of the shoulders to facilitate insertion and removal of the ball element or spherical element into and out of the coupling element 39. Moreover, by positioning the slots 38 between the shoulders 37 and the wall 33, the aperture 36 and shoulders 37 are able to deflect outwardly upon insertion of the ball element 32 or spherical element 24 into the aperture 36 of the coupling element 39 thus facilitating connection and detachment of the ball element 32 or spherical element 24 and the coupling element 39.

Figure 6B:
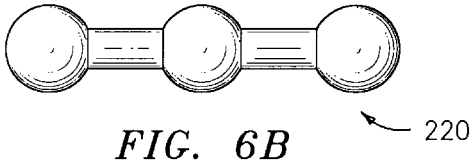
FIG. 6B is a side view of another alternatively configured rod member that may be used in the toy construction system of the present invention.
Figure 6C:
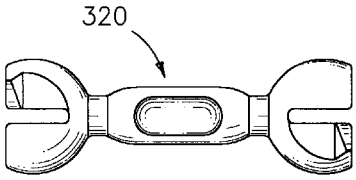
FIG. 6C is a side view of still another alternatively configured rod member that may be used in the toy construction system of the present invention.
Figure 6E:
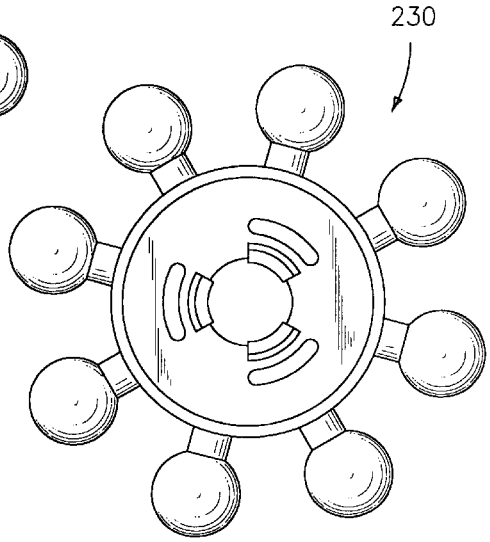
FIG. 6E is a top view of another alternatively configured connector member that may be used in the toy construction system of the present invention.
Figure 6D:
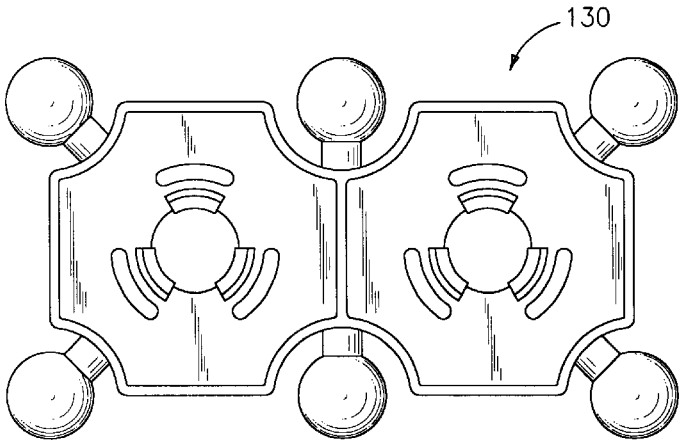
FIG. 6D is a top view of an alternatively configured connector member that may be used in the toy construction system of the present invention.
Figure 6F:
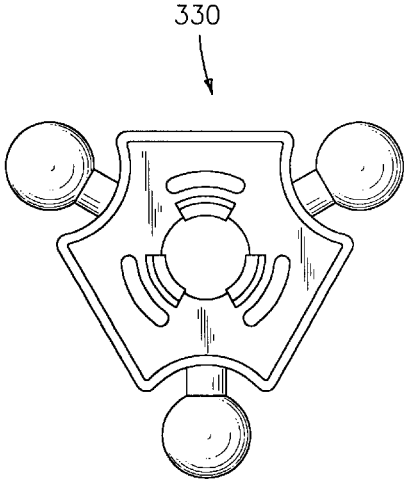
FIG. 6F is a top view of still another alternatively configured connector member that may be used in the toy construction system of the present invention.

As indicated above, the present invention contemplates a number of alternative embodiments of the members described in FIGS. 1 through 5. For example, the rod members 20 and the connector member 30 may assume many different forms and shapes. Moreover, the ball elements 32 and socket elements 23 may be, interchangeably, positioned on different members. FIGS. 6A–C illustrate generally some of the different combinations possible for the rod members referred to generally by reference numerals 120, 220 and 320. Similarly, FIGS. 6D–E illustrate alternative forms of connector members 130, 230 and 330.

Figure 7:
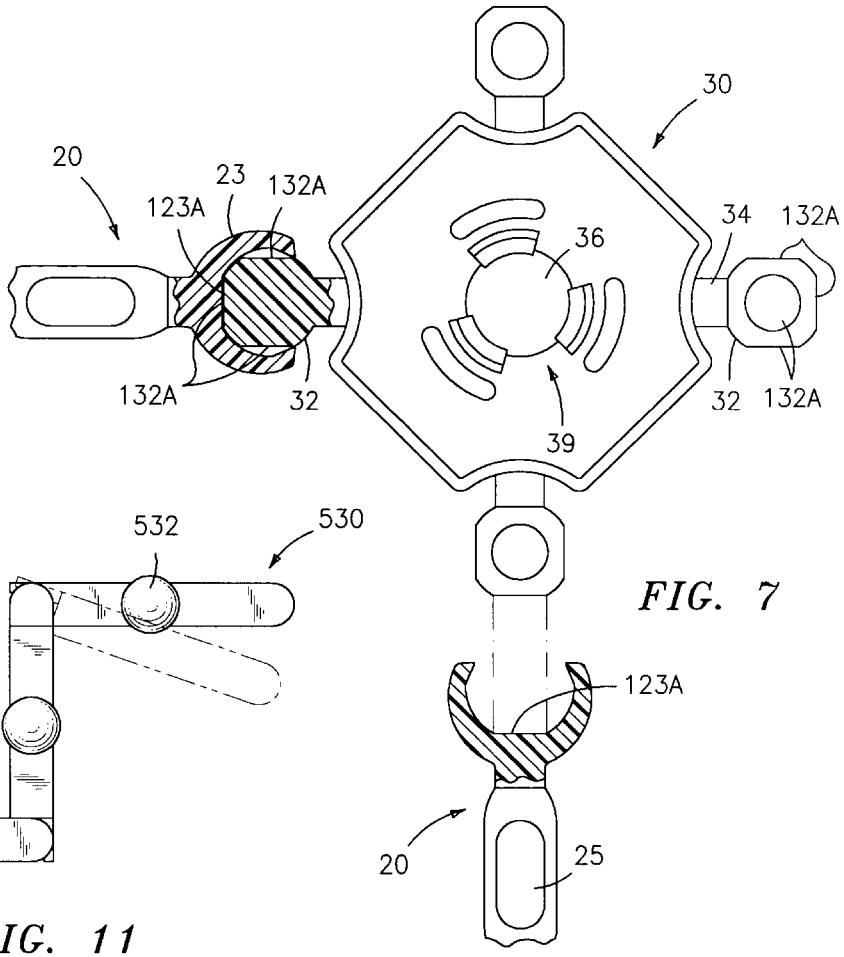
FIG. 7 is a top view of an alternative ball and socket combination that may be used in the toy construction system of the present invention.

The present invention further contemplates alternative forms of the ball and socket joint described generally with respect to the embodiment of FIGS. 1 through 5. For example, locking elements may be provided on the ball and socket elements to permit one to releasably lock a ball element in a set position within the socket element. One such type of possible locking element is illustrated generally in FIG. 7. As shown therein, the ball elements 32 may include at least one flat 132A provided at the outermost end of the ball element 32. Additional flats 132A may also be provided around the periphery of the ball element 32. The flat 132A provided at the outermost end of the ball elements 32 is adapted to engage a complimentary flat 123A positioned at the center of the socket element 23. Flats 132A and 123A permit the ball elements 32 to releasably lock in predetermined positions within the center of the socket elements 32 during use as the flats 132A on the ball elements will engage the flat 123A at the center of the socket element 23 causing the ball elements 32 to releasably lock in that position within the socket element 23.

Figure 8:
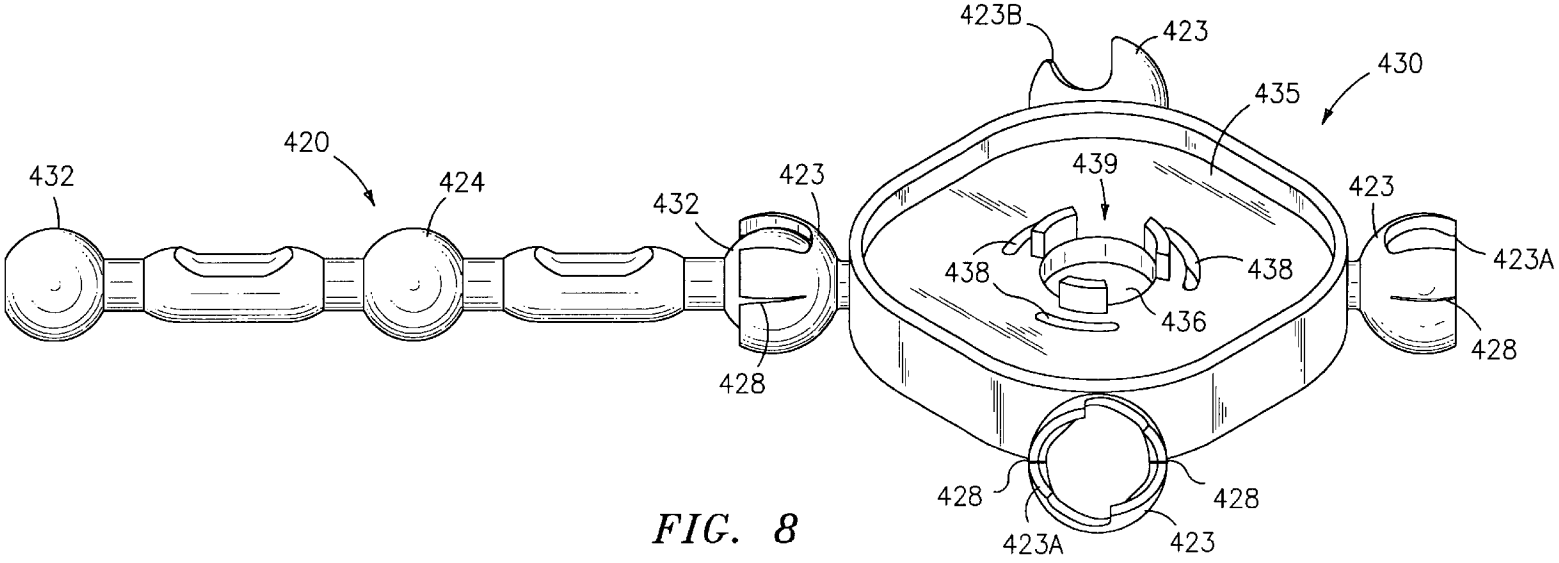
FIG. 8 is a front perspective view of an alternative embodiment of the toy construction system of the present invention.
Figure 5:
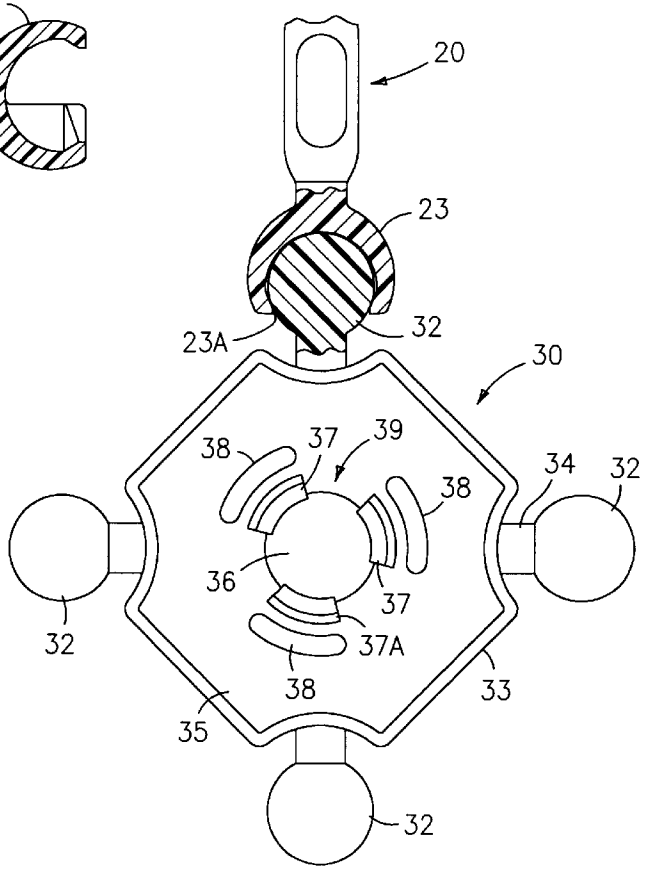
FIG. 5 is a bottom, partially sectional, view illustrating the interconnection between the rod member and the connector member of the toy construction system of the present invention.
Figure 2:
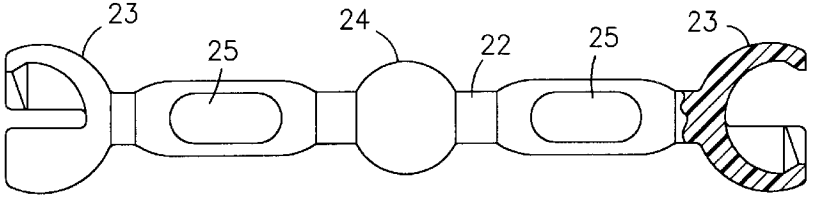
FIG. 2 is a side, partially sectional, view of the rod member of the toy construction system of the present invention.
Figure 4:
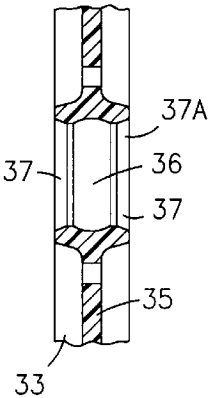
FIG. 4 is a sectional view taken along line 4—4 of FIG. 3.
Figure 2A:
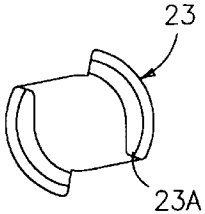
FIG. 2A is an end view of the rod member of FIG. 2.
Figure 3:
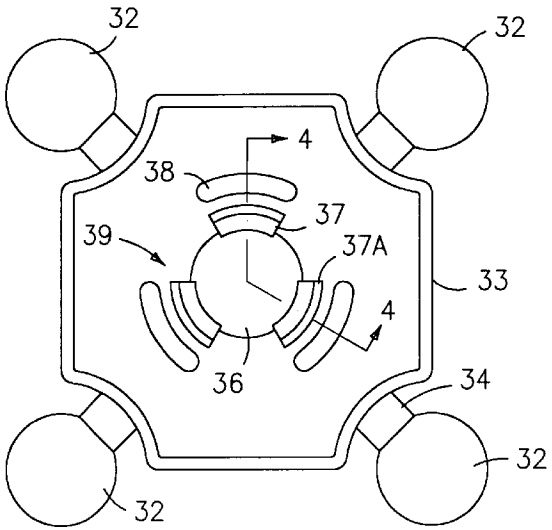
FIG. 3 is a top view of the connector member of the toy construction system of the present invention.

FIG. 8 illustrates still another embodiment of the present invention in which the socket elements 423 are provided on the connector member 430 and the ball elements 432 are provided on the rod member 420. Rod member 420 includes a pair of ball elements 432 provided at the opposite ends thereof and a center spherical element 424. Connector member 430 includes a plurality of socket elements 423 provided about the outer periphery thereof Socket elements 423 include opposed cut-out portions 423B, outer lips 423A to assist in retaining the ball elements 432 therein, a pair of opposed slits 428 extending inwardly from the outer lips 423A between the cut-out portions 423B. It will be appreciated that cut-out portions 423A and slits 428 serve as springs to increase the resiliency of the socket element 423 and facilitate in insertion of the ball elements 432 into the socket elements 423 and their removal therefrom. It will be further appreciated that the slits 428 may also be provided on the socket elements 23 of the embodiment illustrated in FIGS. 1 through 5.

Connector member 430 further includes a coupling element 439 having a center aperture 436 and an integral shoulder section 437 and slots 438 to facilitate insertion of the ball elements 432 and spherical elements 424 into the socket elements 423 and removal of such elements 432 therefrom.

Figure 9:
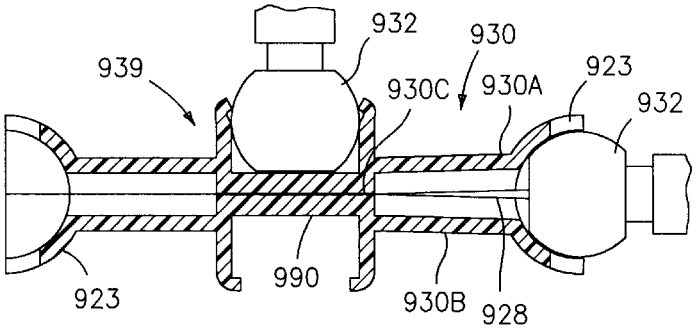
FIG. 9 is a sectional side view of yet another alternative embodiment of the toy construction system of the present invention.

An alternative version of the embodiment of FIG. 8 is illustrated in FIG. 9 in which a connector member 930 is provided having at least two and preferably four socket elements 923 adapted to receive and retain ball elements 932. While the ball elements 932 illustrated herein have a flattened bottom edge, they may similarly be round. Connector member 930 is preferably formed from upper and lower sections 930A and 930B that are sonically welded or glued together in the center thereof along glue line 930C. The interface between upper and lower sections 930A and 930B defines a slit 928 which extends outwardly from the connector member 930 into the socket element 923. It will be appreciated that slit 928 serves as a spring and facilitates the insertion of the ball element 932 into the socket element 923 and its removal therefrom by causing the walls of the socket element to expand upon insertion and removal of the ball element 932.

It should also be appreciated that a modified version of the coupling element 939 is illustrated in FIG. 9 which includes a solid center base portion rather than the center aperture 36 shown, for example, in FIG. 1. The inclusion of such a solid base portion for the coupling element 939 permits the engagement of ball elements 932 on both sides of the connector member 930.

Figure 9A:
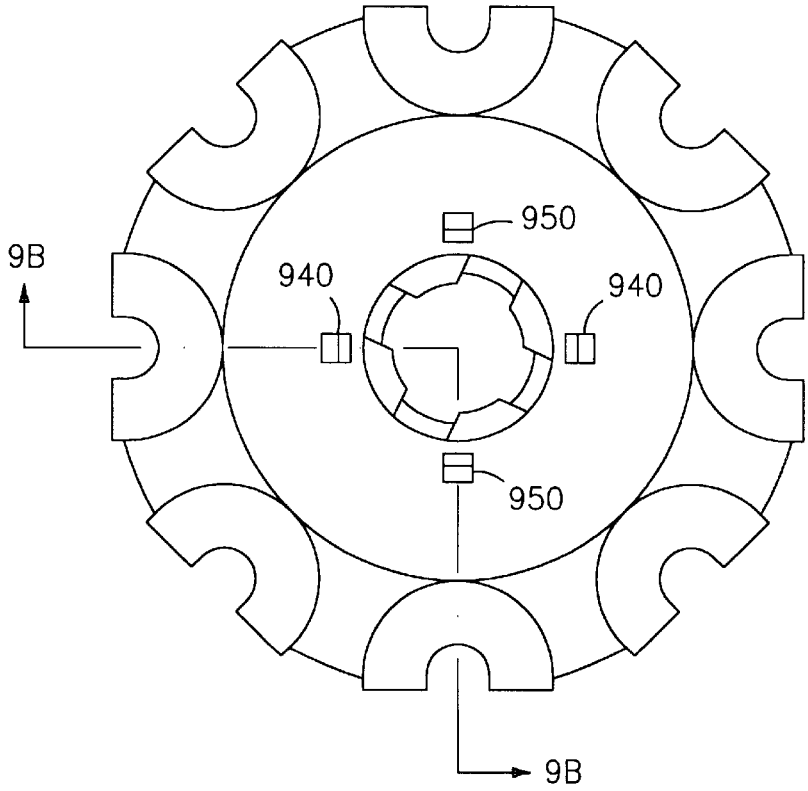
FIG. 9A is a top view of a modified form of the embodiment of FIG. 9.
Figure 9B:
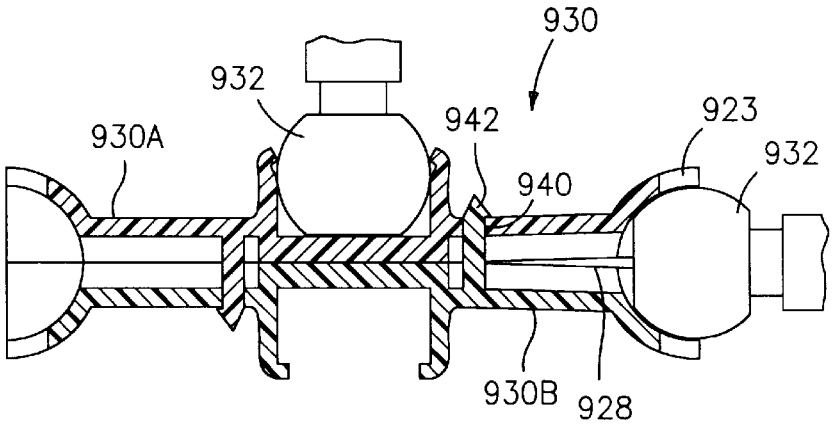
FIG. 9B is a sectional view taken along line 9B—9B of FIG. 9A.

FIG. 9A is a top view of another version of the connector member 930 in which the upper and lower sections 930A and 930B are joined together by locking lugs 940 having detents 942 at their outer edges. In a preferred embodiment, upper and lower sections 930A and 930B each include a pair of opposed locking lugs 950 and a pair of opposed apertures 960 through which the locking lugs 950 from the opposed section are adapted to pass and then engage. The configuration of the locking lugs 940 and detents 942 serve to facilitate insertion of the lugs 940 through complimentary apertures 950. Upon engagement of the detents 942 on the outer surface of the opposite section, the sections 930A and 930B are locked together and socket elements 923 are formed. The interface between the sections 930A and 930B defines a slit 928 which acts as a spring to facilitate insertion and removal of ball elements 932 into and out of socket elements 923.

Figure 11:
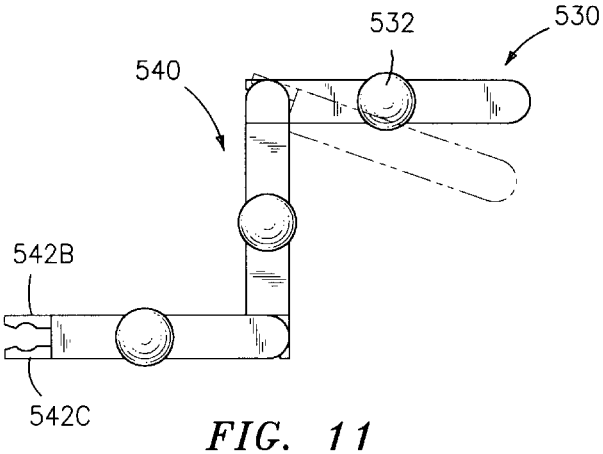
FIG. 11 is a side elevational view of the alternative embodiment of FIG. 10.
Figure 12:
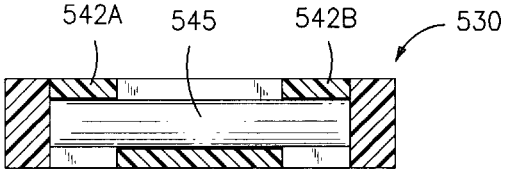
FIG. 12 is a sectional view taken along line 12—12 of FIG. 10.
Figure 10:
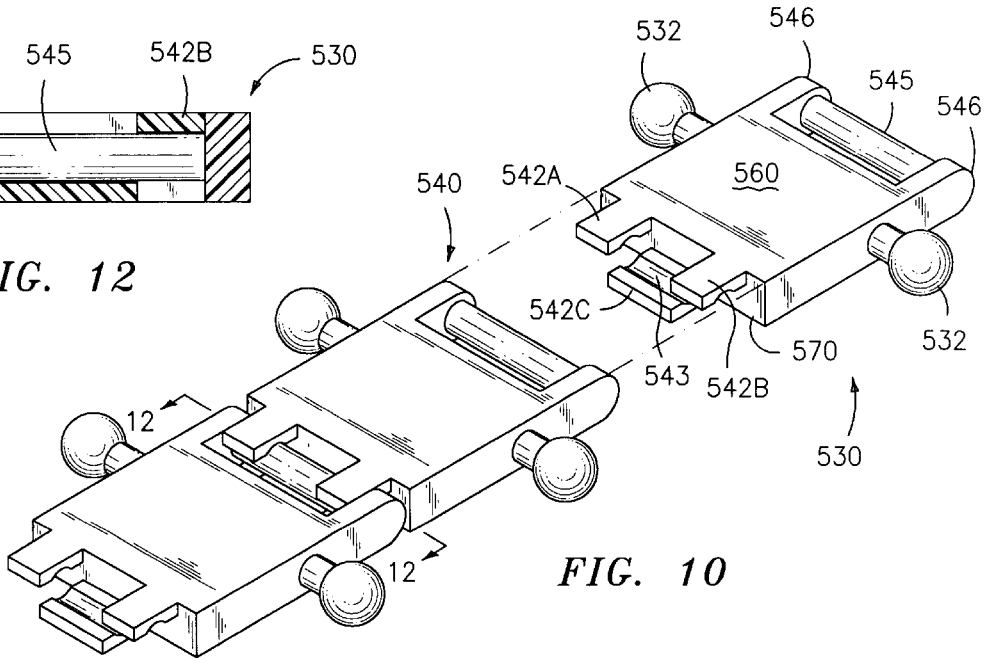
FIG. 10 is a perspective view of still another alternative embodiment of the toy construction system of the present invention.

FIGS. 10–12 illustrate an alternative form of hinged connector member 530 that may be used in conjunction with the toy construction system of the present invention. Hinged connector member 530 is a flattened, elongated member that is adapted to be secured to a variety of other hinged connector members 530 by a flexible hinge joint 540 formed by at least two fingers 542 extending outwardly from one edge of the hinged connector member 530 and a rod 545 provided at the opposite end of the hinged connector member 530.

In the preferred embodiment illustrated in FIGS. 10–12, a pair of upper fingers 542A and 542B extend outwardly from the upper surface 560 of the hinged connector member 530 and a lower finger 542C extends outwardly from the lower surface 570 of the hinged connector. Grooves 543 are provided on the lower surfaces of the upper fingers 542A and 542B and on the upper surface of the lower finger 542C. Fingers 542A, 542B and 542C are flexible. Rod 545 is attached to the opposite end of the hinged connector member 530 by and between opposite arms 546 which extend outwardly from the hinged connector member 530. Hinged connector member 530 may further include opposed ball elements 532.

It will be appreciated that hinged connector members 530 may be interconnected to each other by engagement of the rod 545 between the fingers 542A–C within the grooves 543. This creates a hinged connection which, as shown in FIG. 11, permits a wide range of rotation relative to each other. Interconnected hinged connector members 530 may be rotated relative to each other at angles up to about 90 degrees. The interconnected hinged connector members 530 may be easily separated from each other by exceeding such 90 degree angle as shown in FIG. 11. The hinged connector member 530 may also be connected to rod members 20 and connector member 30 by the ball elements 532 provided thereon.

By providing a plurality of different shaped and configured members as well as a variety of different methods of engagement between such members, the toy construction system of the present invention offers virtually an unlimited number of possible combinations in construction toy structures.

Figure 14:
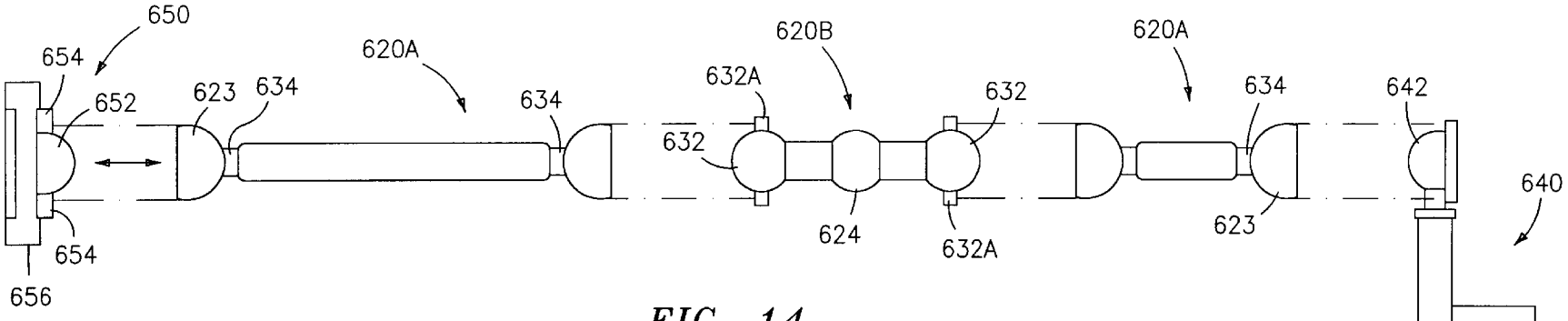
FIG. 14 is an exploded side view illustrating the arrangement of members in the power transmission unit of FIG. 13.
Figure 13:
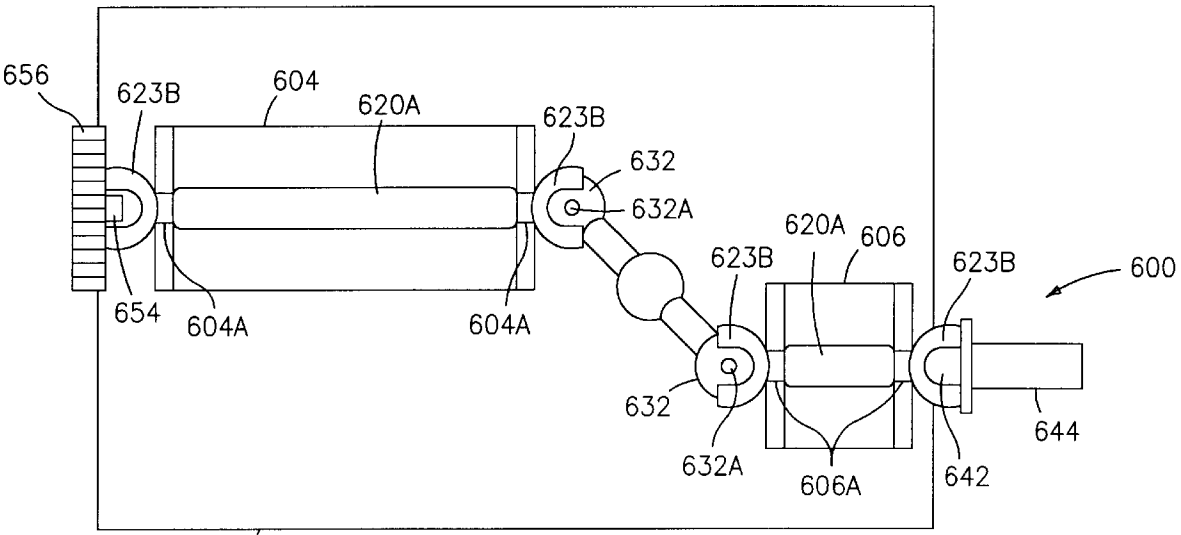
FIG. 13 is a top view of the power transmission unit of the present invention.

FIGS. 13–14 describe a further embodiment of the present invention in the form of a power transmission unit 600 which may be used, for example, in constructing toy steering shafts, gear trains, cranks, pulleys, propellers and the like for vehicles and other structures. Power transmission unit 600 is formed from a base member 602 having raised front and rear bearing journals 604 and 606, respectively with grooves 604A and 606A provided thereon. A plurality of rod members 620A are provided. Certain of these rod members 620A have stems 634 and socket elements 623 provided at their opposite ends. The length of these rod members 620A may vary. Other rod members 620B include ball elements 632 at their opposite ends with a spherical element 624 at the center portion thereof. It will be appreciated that socket elements 623 are similar in size and shape to the other socket elements described herein and include a pair of opposed cut-out portions 623B which are designed to facilitate insertion into and removal of the ball element 632 therefrom. A pair of opposed pins 632A are provided on opposite sides of the ball elements 632.

An "L"-shaped crank member 640 is provided having a spherical element 642 at one end thereof adapted to releasably engage the socket 623 of a rod member 620A and a handle 644 at the opposite end thereof. It should be appreciated that the crank member 640 may assume different shapes such as, for example, wheels, gears, etc. Similarly, a gear member 650 is provided including a spherical element 652 having a pair of opposed pins 654 and gears 656.

FIG. 13 illustrates the manner in which the power transmission unit 600 is attached with rod members 620A being secured to the bearing journals 604 and 606 by engagement of the stems 634 within grooves 604A and 606A provided on the journals 604 and 606, respectively. Rod members 620A are each connected to rod member 620B by the engagement of the complimentary ball and socket joints. Gear member 650 is secured to one of the rod members 620A by engagement of the spherical element 652 on the gear member 650 with the socket 623 on the rod member 620A. Similarly, crank member 640 is secured to the other rod member 620A by engagement of the spherical element 642 on the crank member 640 with the socket 623 on the rod member 620A. This locates the gear axis in line with the socket member axis.

It will be appreciated that the opposed pins 654 on the spherical element 652 of gear member 650 are adapted to fit within the cut-out portions 623B in the socket 623 of the rod member 620A. Similarly, the pair of opposed pins 632A provided on opposite sides of the ball elements 632 of rod member 620B are adapted to fit within the cut-out portions 623B of the sockets 623 of the rod members 620A. When fully attached as shown in FIG. 13, rotation of the crank member 640 causes rotation of the rod members 620A and 620B which translates to rotation of the gear member 650. This is particularly facilitated by the presence of pins 654 and 632A which engage the sides of the cut-out portions 623A of the sockets 623 thus causing the entire unit to rotate as one.

Having thus described the invention with particular reference to the preferred forms thereof, it will be obvious that various changes and modifications can be made therein without departing from the spirit and scope of the present invention as defined by the appended claims.

Wherefore, we claim:

1. A toy construction system including a plurality of elongated rod members and a plurality of substantially flat connector members each of which may be interconnected in a variety of different combinations by the engagement of ball elements provided on certain of said members with complimentary socket elements provided on other of said members, wherein said socket elements each include retaining means for positively retaining said ball elements therein and spring bias means for facilitating the insertion of said ball elements into said socket elements and the removal therefrom, said system further including a plurality of flat, hinged connector members each including at least one ball element for releasably mounting said hinged connector members to other members, wherein said hinged connector members each include an outwardly extending rod and a set of opposed, outwardly extending fingers and wherein at least two of said hinged connector members may be interconnected by engagement of the rod on at least one of said hinged connector members with and between the fingers of another of said hinged connector members.

2. The toy construction system of claim 1, wherein said retaining means comprises an inwardly extending lip provided about at least a portion of said socket elements at their outward end, the inner diameter of said lip being smaller than the outer diameter of said ball elements.

3. The toy construction system of claim 1, wherein said spring bias means comprises a pair of opposed, cut-out portions in said socket elements for causing the diameter of said socket elements to expand upon the insertion of said ball elements therein and the removal therefrom.

4. The toy construction system of claim 1, wherein at least one of said connector members includes at least one coupling element positioned substantially in the center thereof, said at least one coupling element including a center portion and plurality of raised shoulders provided about said center portion.

5. The toy construction system of claim 4, wherein said at least one of said connector members includes a coupling element on both sides thereof.

6. The toy construction system of claim 5, wherein at least one of said rod members includes a spherical element positioned on the body thereof.

7. The toy construction system of claim 6, wherein the coupling element on said at least one connector member is adapted to receive and rotatably engage at least one ball element or spherical element from another of said members.

8. The construction system of claim 7, wherein said at least one connector member includes at least one slot adjacent to each of said shoulders, wherein said slots are adapted to permit the center aperture and raised shoulders to deflect outwardly upon the insertion of the ball elements or spherical elements therein and the removal therefrom to facilitate insertion and removal.

9. The toy construction system of claim 1, wherein at least one of said connector members includes a plurality of ball elements provided about the periphery thereof and projecting outwardly therefrom.

10. The toy construction system of claim 1, wherein at least one of said rod members includes at least one socket element at one of the ends thereof.

11. The toy construction system of claim 10, wherein said at least one of said rod members includes socket elements at the opposite ends thereof.

12. The toy construction system of claim 1, wherein at least one of the socket elements include a pair of opposed slit portions extending inwardly from an outer edge thereof, said slit portions adapted to serve as a second spring means for facilitating the insertion of a ball element therein and removal therefrom.

13. The toy construction system of claim 1, wherein said at least one of ball elements includes at least one flat portion on the periphery thereof and wherein at least one of said socket elements includes a complimentary flat portion at its base adapted to engage at least one of said flat portions on said ball element to releasably lock said ball element in a fixed position within said socket element.

14. The toy construction system of claim 1, wherein at least one of said connector members includes top and bottom halves, said at least one connector member having at least one socket element at an end thereof.

15. The toy construction system of claim 14, wherein the interface between the top and bottom halves extends into said at least one socket element and wherein said interface serves as a second spring means for facilitating the insertion of a ball element therein and removal therefrom.

16. The toy construction system of claim 14, wherein said top and bottom halves are releasably attached by at least one locking element.

17. The toy construction system of claim 1, wherein said set includes at least two opposed fingers, the opposed surfaces of said fingers having a groove adapted to receive and retain a rod from another of said hinged connector members.

18. The toy construction system of claim 1, wherein said interconnected hinged connectors are adapted to disengage from each other when rotated more than 90 degrees relative to each other.

19. The toy construction system of claim 18, wherein said pair of interconnected hinged connectors are adapted to disengage when rotated relative to each other more than 90 degrees.

20. The toy construction system of claim 1, further including a power transmission unit including a plurality of rod members having complimentary ball and socket joints and adapted to be interconnected to one another by engagement of said ball and socket joints, a gear member adapted to engage one of said rod members and a crank member adapted to engage another of said rod members.

21. A toy construction system including a plurality of members of different sizes and shapes each of which are adapted to be interconnected in a variety of different combinations to form different shapes, said toy system including:

a plurality of elongated rod members each having at least one socket element at an end thereof; and a plurality of substantially flat connector members each having at least one ball element at an end thereof and at least one coupling element at the center thereof;

wherein said at least one socket element on said rod members and said at least one coupling element on said connector members each include retaining means for positively retaining said ball elements therein and spring bias means for facilitating the insertion of said ball elements therein and the removal therefrom, wherein said system further includes a plurality of flat, hinged connector members each including at least one ball element for releasably mounting said hinged connector members to other members, said hinged connector members each including an outwardly extending rod and a set of opposed, outwardly extending fingers and wherein at least two of said hinged connector members may be interconnected by engagement of the rod on at least one of said hinged connector members with and between the fingers of another of said hinged connector members.

22. The toy construction system of claim 21, wherein certain of said rod members include at least one spherical element on a portion thereof for engaging the coupling element on said connector members.

23. The toy construction system of claim 21, wherein the retaining means for said at least one socket element comprises an inwardly extending lip provided about at least a portion thereof at its outward end, the inner diameter of said lip being smaller than the outer diameter of said ball elements.

24. The toy construction system of claim 4, wherein the spring bias means for said at least one socket element comprises a pair of opposed, cut-out portions for causing the diameter of said socket element to expand upon the insertion of said ball elements therein and the removal therefrom.

25. The toy construction system of claim 21, wherein said at least one coupling element includes a center aperture through said connector member and plurality of raised shoulders provided about said center aperture.

26. The toy construction system of claim 25, wherein the retaining means for said at least one coupling element comprises an inwardly extending lip provided at the outward end of said raised shoulders, the inner diameter of said lip being smaller than the outer diameter of said ball elements.

27. The toy construction system of claim 21, wherein the spring bias means for said at least one coupling element comprises the spaces between said shoulders which permit the shoulders to deflect outwardly upon the insertion of said ball elements therein and the removal therefrom.

28. The toy construction system of claim 27, wherein said at least one coupling element further includes second spring means for facilitating the insertion of said ball elements therein and the removal therefrom, said second spring means comprising at least one slot positioned adjacent to each of said shoulders and adapted to cause the center aperture and raised shoulders to deflect outwardly upon the insertion of the ball elements or spherical elements therein and the removal therefrom.

29. The toy construction system of claim 21, wherein said set includes at least two opposed fingers, the opposed surfaces of said fingers having a groove adapted to receive and retain a rod from another of said hinged connector members.

30. The toy construction system of claim 21, wherein said pair of interconnected hinged connectors are adapted to disengage from each other when rotated in excess of 90 degrees relative to each other.

31. The toy construction system of claim 21, further including a power transmission unit including a plurality of rod members having complimentary ball and socket joints and adapted to be interconnected to one another by engagement of said ball and socket joints, a gear member adapted to engage one of said rod members and a crank member adapted to engage another of said rod members.

32. A toy construction system including a plurality of members of different sizes and shapes each of which are adapted to be interconnected in a variety of different combinations to form different shapes, said toy system including:

a plurality of elongated rod members, each of said rod members having at least one socket element at an end thereof, wherein at least one of said elongated rod members includes a spherical element on a portion thereof; and a plurality of substantially flat connector members, each of said flat connector members having at least one ball element at an end thereof and at least one coupling element at the center thereof, wherein said at least one coupling element includes a center aperture and a plurality of raised shoulders provided about said center aperture;

wherein said at least one socket element and said at least one coupling element each include retaining means for positively retaining either a ball element or a spherical element therein and spring bias means for facilitating the insertion of either a ball element or a spherical element therein and removal therefrom, wherein said system further includes a plurality of flat, hinged connector members each including at least one ball element for releasably mounting said hinged connector members to other members, said hinged connector members each including an outwardly extending rod and a set of opposed, outwardly extending fingers, wherein at least two of said hinged connector members may be interconnected by engagement of the rod on at least one of said hinged connector members with and between the fingers of another of said hinged connector members.

33. The toy construction system of claim 32, wherein the retaining means for said at least one socket element comprises an inwardly extending lip provided about at least a portion thereof at its outward end and wherein the retaining means for said at least one coupling element comprises an inwardly extending lip at the outward edge of said shoulders.

34. The toy construction system of claim 32, wherein the spring bias means for said at least one socket element comprises a pair of opposed, cut-out portions and wherein the spring bias means for said coupling element comprises the spaces between said shoulders.

35. The toy construction system of claim 32, wherein said coupling element further includes second spring means comprising at least one slot positioned adjacent to each of said shoulders on its side opposite said center aperture for causing the center aperture and raised shoulders to deflect outwardly upon the insertion of ball elements or spherical elements therein and the removal therefrom.

36. The toy construction system of claim 32, further including a power transmission unit including a plurality of rod members having complimentary ball and socket joints and adapted to be interconnected to one another by engagement of said ball and socket joints, a gear member adapted to engage one of said rod members and a crank member adapted to engage another of said rod members.

37. A toy construction system including a plurality of members of different sizes and shapes each of which are adapted to be interconnected in a variety of different combinations to form different shapes, said toy system including:

a plurality of elongated rod members, each of said rod members having at least one socket element at an end thereof, wherein at least one of said rod members includes at least one spherical element on a body portion thereof;

a plurality of substantially flat connector members, each of said flat connector members having at least one ball element at an end thereof and at least one coupling element at the center thereof; and a plurality of flat hinged connector members each including at least one ball element on a side thereof, said hinged connector members each including an outwardly extending rod and a set of opposed, outwardly extending fingers which permit the interconnection of said hinged connector members by the engagement of the rod on at least one of said hinged connector members with and between the fingers of another of said hinged connector members, wherein each of said members may be interconnected with another of said members by the engagement of a ball element or a spherical element with a complimentary socket element or a coupling element.

38. A toy construction system including a plurality of members of different sizes and shapes each of which are adapted to be interconnected in a variety of different combinations to form different shapes, said toy system including:

a plurality of elongated rod members, each of said rod members having at least one socket element at an end thereof and wherein at least one of said rod members includes a spherical element thereon;

a plurality of substantially flat connector members, each of said flat connector members having at least one ball element at an end thereof and at least one coupling element at the center thereof, wherein said at least one socket element and said at least one coupling element each include retaining means for positively retaining said ball elements or spherical elements therein and spring bias means for facilitating the insertion of said ball elements or spherical elements therein and removal therefrom, said at least one coupling element includes a center aperture and plurality of raised shoulders provided about said center aperture and wherein said coupling element further includes second spring means for further facilitating the insertion of said ball elements or spherical elements therein and removal therefrom; and a plurality of flat hinged connector members each including at least one ball element provided on a side thereof for releasably mounting said hinged connector members to other members, said hinged connector members each including an outwardly extending rod and a set of opposed, outwardly extending fingers to permit interconnection of said hinged connector members by engagement of the rod on at least one of said hinged connector members with and between the fingers of another of said hinged connector members.

39. The toy construction system of claim 38, further including a power transmission unit including a plurality of rod members having complimentary ball and socket joints and adapted to be interconnected to one another by engagement of said ball and socket joints, a gear member adapted to engage one of said rod members and a crank member adapted to engage another of said rod members.

40. A toy construction system including a plurality of members of different sizes and shapes each of which are adapted to be interconnected in a variety of different combinations to form different shapes, said toy system including:

a plurality of elongated rod members, each of said rod members having at least one socket element at an end thereof and wherein at least one of said rod members includes a spherical element thereon;

a plurality of substantially flat connector members, each of said flat connector members having at least one ball element at an end thereof and at least one coupling element at the center thereof, wherein said at least one socket element and said at least one coupling element each include retaining means for positively retaining said ball elements or spherical elements therein and spring bias means for facilitating the insertion of said ball elements or spherical elements therein and removal therefrom, said at least one coupling element includes a center aperture and plurality of raised shoulders provided about said center aperture and wherein said coupling element further includes second spring means for further facilitating the insertion of said ball elements or spherical elements therein and removal therefrom;

a plurality of flat hinged connector members each including at least one ball element provided on a side thereof for releasably mounting said hinged connector members to other members, said hinged connector members each including an outwardly extending rod and a set of opposed, outwardly extending fingers to permit interconnection of said hinged connector members by engagement of the rod on at least one of said hinged connector members with and between the fingers of another of said hinged connector members; and a power transmission unit including a plurality of rod members having complimentary ball and socket joints and adapted to be interconnected to one another by engagement of said ball and socket joints, a gear member adapted to engage one of said rod members and a crank member adapted to engage another of said rod members.

41. A toy construction system including a plurality of members of different sizes and shapes each of which are adapted to be interconnected in a variety of different combinations to form different shapes, said toy system including a power transmission unit including a plurality of rod members having complimentary ball and socket joints and adapted to be interconnected to one another by engagement of said ball and socket joints, a gear member adapted to engage one of said rod members and a crank member adapted to engage another of said rod members, said system further including a plurality of flat, hinged connector members each including at least one ball element for releasably mounting said hinged connector members to other members, wherein said hinged connector members each include an outwardly extending rod and a set of opposed, outwardly extending fingers and wherein at least two of said hinged connector members may be interconnected by engagement of the rod on at least one of said hinged connector members with and between the fingers of another of said hinged connector members.

42. A toy construction system including a plurality of elongated rod members and a plurality of connector members, wherein said members may be detachably interconnected and pivotally rotated relative to each other by the engagement of projecting ball elements provided on certain of said members or by engagement of the body of the member with complimentary socket elements provided on other of said members, wherein said socket elements each include retaining means for positively retaining said ball elements or the body of said member therein and spring bias means for facilitating the insertion of said ball elements or the body of said member into said socket elements and the removal therefrom.

43. The toy construction system of claim 42, wherein said retaining means comprises an inwardly extending lip provided about at least a portion of said socket elements at their outward end, the distance between opposing lips being less than the outer diameter of said ball elements or the width of the body of said members.

44. The toy construction system of claim 42, wherein said spring bias means comprises a pair of opposed, cut-out portion sin said socket elements for causing the outer edges of said socket elements to expand upon the insertion of said ball elements or there body of said members therein and the removal therefrom.

* * * * *